US005613620A

United States Patent [19]

Center et al.

[11] Patent Number: 5,613,620

[45] Date of Patent: *Mar. 25, 1997

[54] CO-DISPENSING SNACK FOOD PRODUCTS AND BEVERAGES FROM A VENDING MACHINE

[75] Inventors: John L. Center; James W. Stalder, both of Dallas, Tex.

[73] Assignee: Recot, Inc., Pleasanton, Calif.

[ * ] Notice: The term of this patent shall not extend beyond the expiration date of Pat. No. 5,445,287.

[21] Appl. No.: 419,605

[22] Filed: Apr. 10, 1995

Related U.S. Application Data

[63] Continuation-in-part of Ser. No. 289,537, Aug. 12, 1994, Pat. No. 5,445,287.

[51] Int. Cl.[6] ..... B65H 1/00

[52] U.S. Cl. ..... 221/133; 221/1; 221/150 R; 221/15; 221/195

[58] Field of Search ..... 221/183–24, 199, 221/150 R, 133, 12, 151, 152, 153

[56] References Cited

U.S. PATENT DOCUMENTS

| | | | |
|---|---|---|---|
| 2,901,964 | 9/1959 | Johnson . | |
| 2,956,660 | 10/1960 | Nordquist | 221/193 X |
| 2,963,883 | 12/1960 | Teesdale | 221/150 R |
| 3,001,669 | 9/1961 | Tandler et al. . | |
| 3,132,732 | 5/1964 | Robillard . | |
| 3,232,400 | 2/1966 | Hendrickson . | |
| 3,294,282 | 12/1966 | Brown . | |
| 3,549,045 | 12/1970 | Rosenhagen . | |
| 3,810,561 | 5/1974 | Merkl . | |
| 4,235,351 | 11/1980 | Kolbl et al. . | |
| 4,299,334 | 11/1981 | Weatherly . | |
| 4,326,568 | 4/1982 | Burton et al. . | |
| 4,483,459 | 11/1984 | Taylor et al. . | |
| 4,591,070 | 5/1986 | Wirstlin . | |
| 4,730,750 | 3/1988 | Ficken | 221/124 |
| 4,852,767 | 8/1989 | Humphrey . | |
| 4,899,790 | 2/1990 | Odenthal . | |
| 4,920,764 | 5/1990 | Martin | 221/150 R |
| 4,991,740 | 2/1991 | Levasseur . | |
| 4,997,106 | 3/1991 | Rockola . | |
| 5,147,068 | 9/1992 | Wright . | |
| 5,176,287 | 1/1993 | Suris | 221/93 |
| 5,178,298 | 1/1993 | Allina | 221/199 X |
| 5,199,598 | 4/1993 | Sampson . | |
| 5,207,784 | 5/1993 | Schwartzendruber . | |
| 5,361,938 | 11/1994 | Ishine | 221/193 X |

FOREIGN PATENT DOCUMENTS

| | | |
|---|---|---|
| 0411769 | 2/1991 | European Pat. Off. . |
| 4110368 | 10/1992 | Germany . |

OTHER PUBLICATIONS

McDowell, E., "One–Stop Shopping in the Mini–Bar", *New York Times*, Feb. 7, 1995 (late edition). section D, p. 1. col. 3.

Photograph of paperboard snack food containers.

"Health Gards" advertisement from Vending Times, Jul. 1987, p. 14.

International Search Report dated Dec. 11, 1995 for related international application No. PCT/US95/10222.

*Primary Examiner*—William E. Terrell
*Assistant Examiner*—Khoi H. Tran
*Attorney, Agent, or Firm*—Rothwell, Figg, Ernst & Kurz

[57] ABSTRACT

A process for co-dispensing beverages and snack food products from a single vending machine, and a vending machine including filled beverage and snack food containers. Filled beverage containers and filled snack food containers are stored in the vending machine and a buyer, upon payment, product selection, etc., can obtain both a beverage, e.g., a soft drink, and a snack food, e.g., corn chips, from a single machine. The beverage and snack food containers preferably are of substantially the same size so that a vending machine of the type which dispenses containers having a uniform size may be used to carry out the present invention. An automatic door-opening mechanism opens the dispensing door of a vending machine when a snack food container is selected to avoid problems due to the snack food container being too light to open the door under the force of gravity.

17 Claims, 5 Drawing Sheets

CO-DISPENSING SNACK FOOD PRODUCTS AND BEVERAGES FROM A VENDING MACHINE

CROSS-REFERENCE TO RELATED APPLICATION

This application is a continuation-in-part of application Ser. No. 289,537, filed Aug. 12, 1994, now U.S. Pat. No. 5,445,287.

BACKGROUND OF THE INVENTION

1. Field of the Invention

The present invention relates generally to dispensing containers from vending machines or the like and, more particularly, to dispensing both snack food products and beverages from a single vending machine.

2. Description of Relevant Art

It is well known in the prior art to dispense beverages, e.g., cans of soft drinks, from a coin-operated vending machine. Coin-operated vending machines also are used to dispense packages of food products, e.g., candy, snack foods such as potato chips or pretzels, or sandwiches.

In the snack food art, salty snack food products, e.g. corn chips, cheese snacks, pretzels, etc., typically are packaged in bags formed of flexible packaging films, or canisters formed of paperboard material. These packaging films typically are complex laminated structures that provide moisture and oxygen barrier layers to prevent premature staling or loss of product freshness. In addition, it is known to package food products such as peanuts in a metal can having a resealable lid for maintaining product freshness.

In the prior art, a plurality of vending machines often are disposed or located together in a common area, e.g., a travel rest area or a snack bar. The machines contain and dispense various beverages, snack foods, candy, etc. However, in arrangements of the above-described type, the separate vending machines respectively dispense separate types of products. That is, a machine typically dispenses either beverages or food products, but not both. For example, a machine which dispenses cans of soft drinks does not dispense food products. Consequently, a purchaser cannot obtain a beverage and a snack food product from prior art soft drink vending machines.

The cost of a vending machine often prohibits its placement in certain locations where "turns," or purchases of the vended products, are not of sufficient frequency (relative to the product's shelf life) to provide an adequate return on investment. For this reason, it is not uncommon to find beverage vending machines standing alone without a snack food vending machine. Also, as beverage vending machines are refrigerated while snack food vending machines are not, there are many outdoor vending locations that are hostile to the placement of snack food vending machines due to temperature and moisture extremes.

Snack-food or rest-area vending arrangements often include an oven for cooking food products purchased from the machines. It is known in the prior art to combine a microwave oven with a food-vending machine to permit the products to be cooked and then dispensed to the purchaser. See e.g., U.S. Pat. No. 5,147,068, which teaches that the food products may be dispensed by a conventional soft drink vending machine. The 5,147,068 patent, however, does not teach or suggest dispensing both a beverage product and a food product from a single vending machine but, rather, teaches only the conventional usage of a machine to dispense only one product or the other.

U.S. Pat. No. 2,901,964 discloses a vending machine with means for heating refrigerated sandwiches. The purchaser selects a type of sandwich which is then heated and dispensed by the machine. U.S. Pat. No. 5,207,784 discloses a monitoring system for monitoring the inventory status of vending machines from a remote location. U.S. Pat. No. 3,810,561 discloses a vending machine for dispensing containers having a circular cross-section through a discharge port. The 3,810,561 patent teaches that although the containers typically will be cans of soda, other items also can be dispensed in the circular containers. However, as with the patents mentioned above, the 3,810,561 patent does not teach or suggest dispensing both a beverage and food product from a single soft drink vending machine.

It is apparent that prior art product vending or dispensing apparatus, such as those discussed above, dispense either a beverage or a food product and, therefore, do not permit a purchaser to obtain both a beverage, e.g. a soft drink, and a snack food product, e.g. corn chips, from a single soft drink vending machine. Accordingly, there is a need in the art for improved dispensing of such products.

SUMMARY OF THE INVENTION

The present invention provides a process for co-dispensing beverages and snack food products from a single vending machine, i.e., dispensing both filled beverage containers and filled food product containers from the same vending machine. Although not absolutely necessary to carry out the process of the present invention, the food product containers preferably have a size and shape substantially the same as the size and shape of the beverage containers. For example, both containers can be aluminum cans with a removable opening. This permits a conventional, refrigerated soft drink vending machine to be used to dispense both beverages and food products according to the present invention. Thus, the present invention provides a highly economical and efficient system for dispensing both refrigerated beverages and snack foods via pre-existing soft drink vending machines. The invention also includes an automatic door-opening mechanism for use in vending machines which have a dispensing door that is pushed open by the weight of the container. For snack food containers that are too light to push the door open, the mechanism holds the dispensing door open until the containers pass therethrough.

BRIEF DESCRIPTION OF THE DRAWINGS

Other objects, features and advantages of the present invention will become more apparent from the following detailed description of a preferred embodiment thereof taken in conjunction with the accompanying drawing figures, wherein.

DETAILED DESCRIPTION OF PREFERRED EMBODIMENTS

As stated above, the present invention relates to co-dispensing beverages and food products from a single vending machine. For the sake of simplicity, apparatus which may be utilized to carry out the present invention are referred to collectively as vending machines. Such apparatus include, but are not limited to, conventional coin-operated soft drink vending machines known in the art.

Figure 1A:
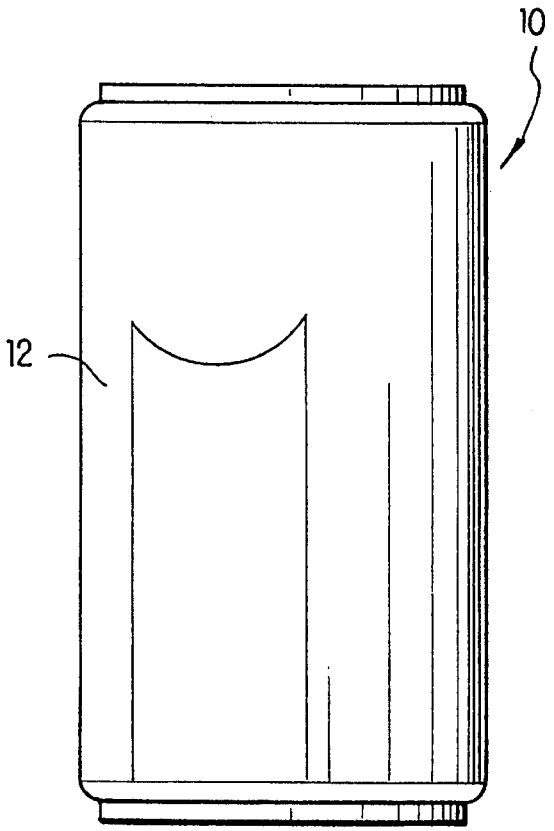
FIGS. 1A and 1B, respectively, are elevation views of a filled beverage container and a filled food product container which may be dispensed from a single vending machine according to the process of the present invention.
Figure 1B:
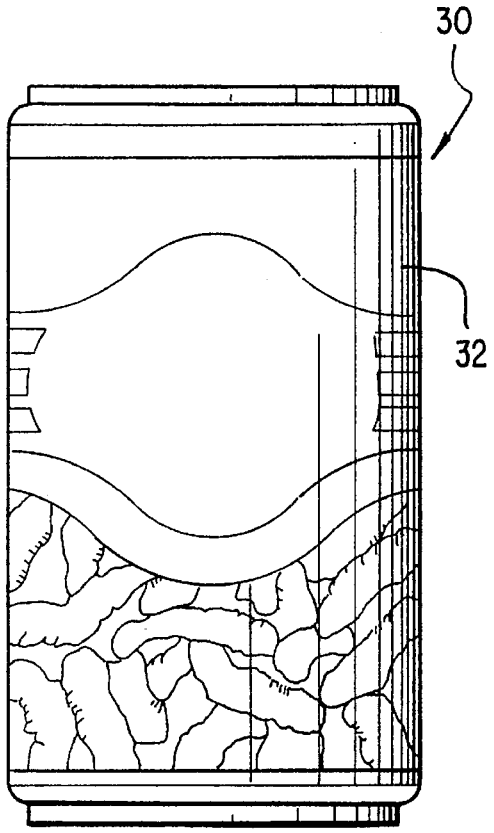
Figure 2A:
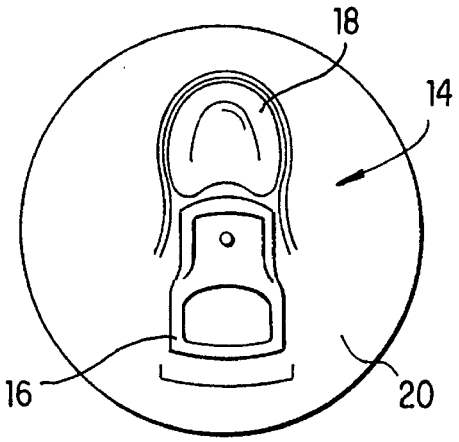
FIGS. 2A and 2B, respectively, are plan views of the containers depicted in FIGS. 1A and 1B.

FIG. 1 depicts a filled beverage container 10 and a filled snack food product container 30. The beverage container 10 preferably is aluminum and has a shape and size such that the container can be dispensed by a conventional soft drink vending machine. Beverage container 10 can be in the form of a conventional recyclable aluminum soft drink can including a body 12 with suitable advertising indicia as seen in FIG. 1A, and a pop-top or like easy opening closure indicated generally at 14 (FIG. 2A). Closure 14 is conventional and includes a pull ring 16 which is lifted upward to punch section 18 from upper surface 20 to provide an outlet, all as known in the art.

Figure 2B:
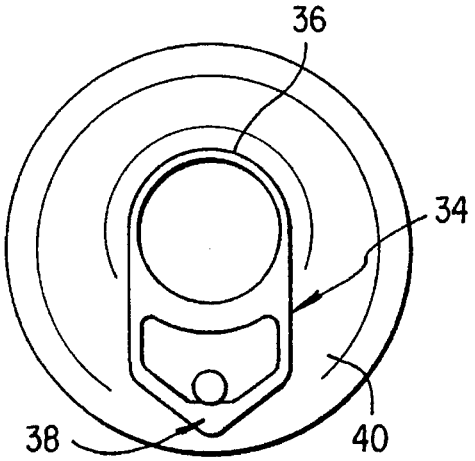

Snack food product container 30 likewise can be in the form of a recyclable aluminum can having a body 32 with advertising indicia and an easy-opening closure indicated generally at 34 (FIG. 2B). As will be explained below, utilizing a snack food container that has the same or substantially the same size and shape as a conventional soft drink can permits a conventional soft drink vending machine to be used in practicing the present invention. Closure 34 differs from the closure 10 of beverage container 10 in that substantially the entire upper surface 40 of container 30 preferably is removed to gain access to the contents thereof, i.e., the snack food product which, in FIG. 1B, is a snack food marketed by Frito-Lay, Inc. under the trademark CHEE·TOS® brand cheese flavored snacks. Pull ring 36 is grasped and lifted upward to depress portion 38 of surface 34 so as to permit easy removal thereof. This type of closure is known in the art and, therefore, is not discussed in further detail herein.

It will be recognized that containers 10 and 30 may be of any size. For example, the containers may have a 12 or 16 fluid ounce capacity, or any other fluid capacity. Fluid capacity, of course, refers to both containers 10 and 30 although only container 10 contains a beverage. In a preferred embodiment, both container 10 and container 30 have a 12 fluid ounce capacity, and, therefore, may be dispensed by a conventional soft drink vending machine.

Figure 3:
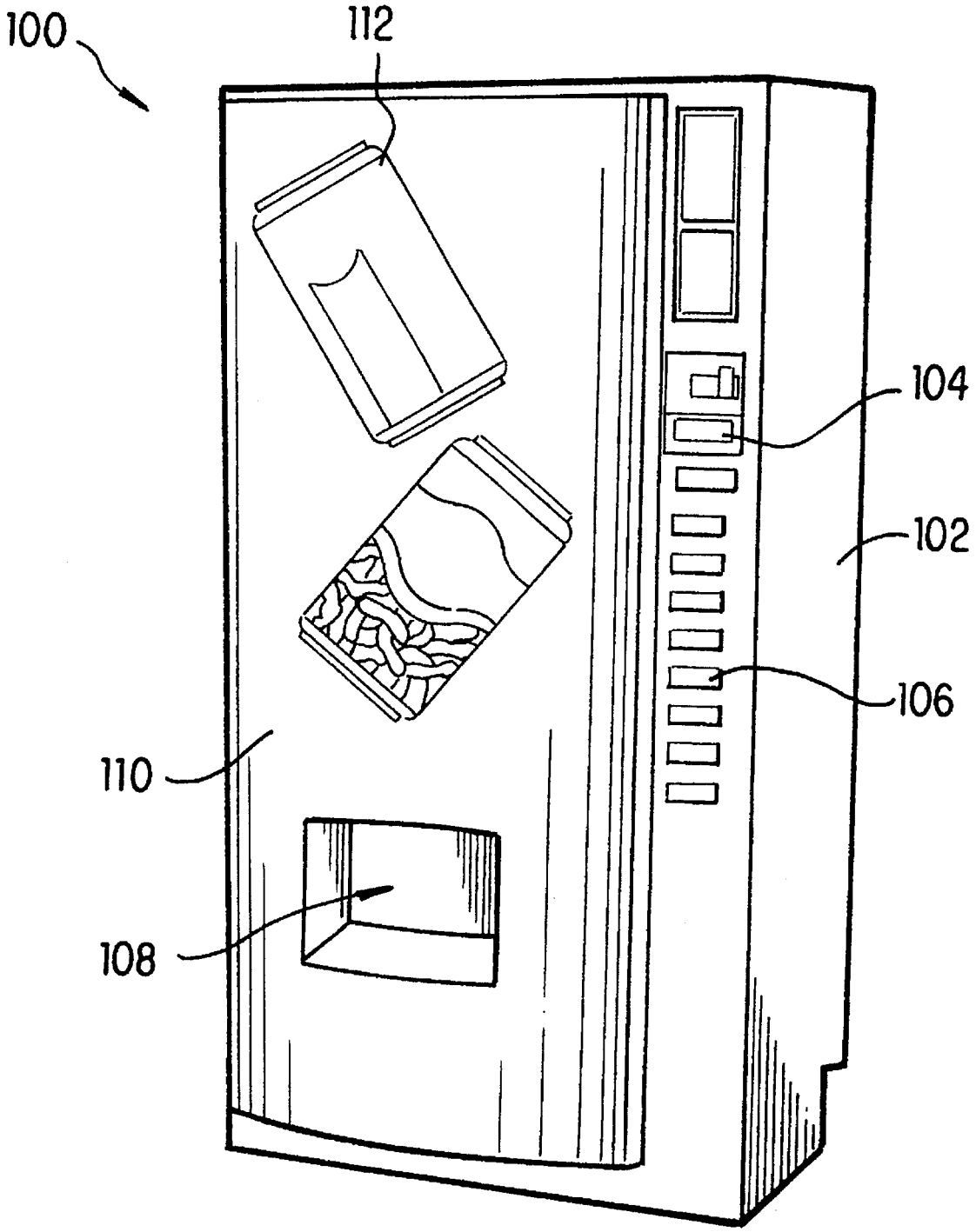
FIG. 3 is a perspective schematic view of a vending machine that may be used in carrying out the process of the present invention.

FIG. 3 shows a perspective schematic view of a vending machine for dispensing both food and beverage containers according to the present invention. The vending machine 100 includes an outer housing 102, a payment mechanism 104, a selector panel mechanism 106, and a dispensing outlet 108. The vending machine 100 further includes a front door 110 which is pivotally connected to housing 102 and can be opened to provide access to the interior of the machine, e.g., to refill the product supply and collect the money deposited in the machine. The front door 110 of vending machine 100 can have a suitable advertising display or indicia 112 which, in FIG. 1, depicts a beverage item and a snack food item contained therein.

The operation of vending machine 100 is well known to and appreciated by those skilled in the art and thus will not be explained in any great detail herein. As mentioned above, the process of the present invention can be carried out utilizing conventional soft drink vending apparatus, i.e., the present invention does not require a specifically designed vending machine. Thus, the operation of such apparatus in response to the insertion of money therein will not be described in detail. The process of the present invention can be practiced with a vending machine having sufficient internal space for storage of filled beverage and snack food containers, and means for permitting a user to select a specific beverage or food item which item is dispensed upon the insertion of sufficient money in the machine. Accordingly, it is possible to employ a conventional soft drink vending machine by using a portion of the soft drink container storage area for food product containers. Thus, the structure (e.g. tracks) used to convey or direct soft drink containers to the outlet from the stacks in that portion of the storage area, according to the present invention, instead direct snack food containers to the outlet from the stacks in that storage portion.

Although those skilled in the art will appreciate the use of a conventional vending machine to carry out the present invention (as described above), a brief discussion of such a machine will be made for the sake of clarity.

Conventional soft drink vending machines typically have a plurality of holding stacks of a certain width and depth for holding a supply of soft drink containers. A dispenser mechanism is disposed at a lower portion of each holding stack and is operable by a drive mechanism. The drive mechanisms, in response to purchaser selection, operate the respective dispenser mechanisms to dispense a soft drink container via the vending machine outlet. For example, U.S. Pat. No. 4,991,740 discloses a known type of vending machine that may be used in carrying out the process of the present invention. The 4,991,740 patent discloses a vending machine including horizontally-spaced container stacks with respective release mechanisms and a single machine outlet, as disclosed in FIGS. 1–5 and columns 4–8 of the 4,991,740 patent, which disclosure is expressly incorporated by reference into the present application. However, those skilled in the art, of course, will appreciate that other vending machine structures and apparatus may be used as well.

Other known vending machines, e.g., those which include vertically-spaced container stacks, may also be used to carry out the present invention. U.S. Pat. No. 4,483,459 discloses a machine having vertically-spaced container stacks, as seen in FIGS. 2 and 3 therein. The operation of the vending machine in the 4,483,459 patent is disclosed in FIGS. 2–5 and columns 2–5, which disclosure also is expressly incorporated by reference in the present application.

Figure 5:
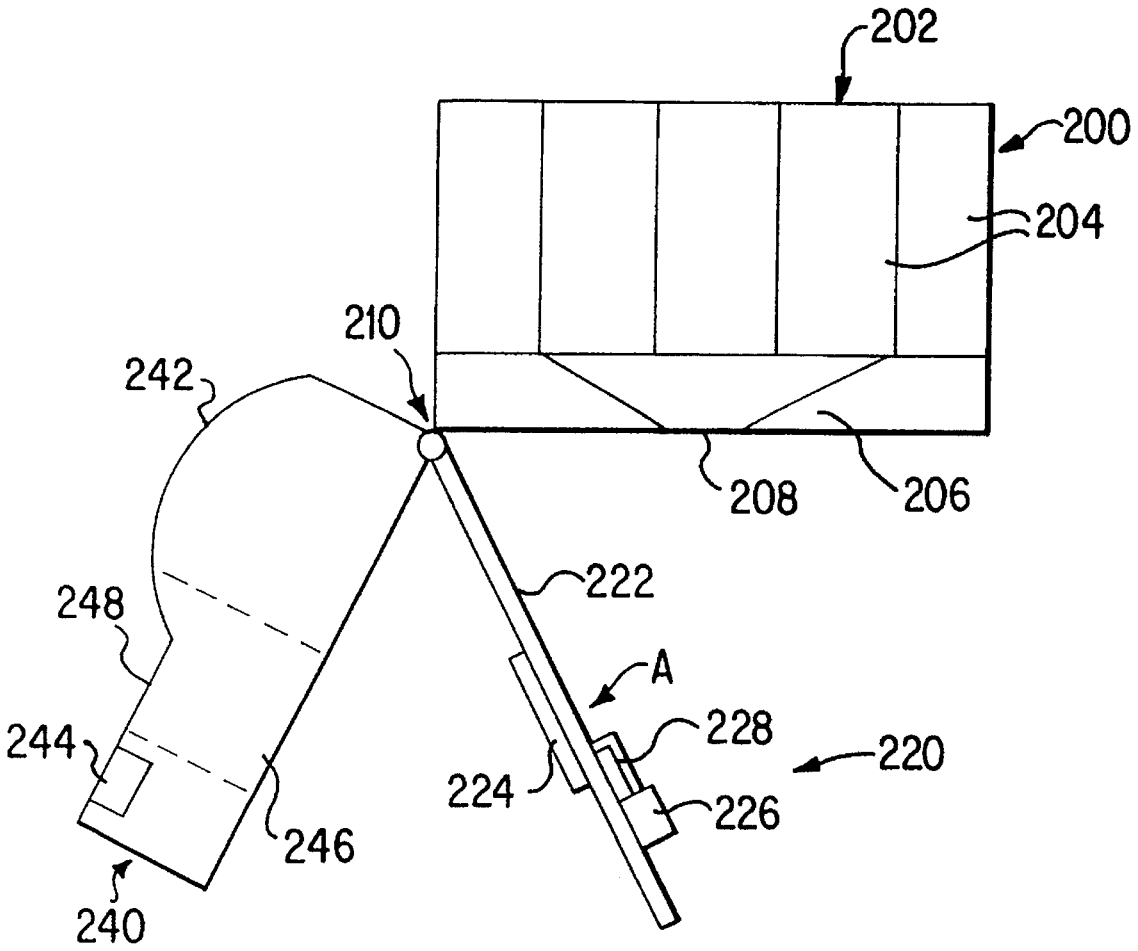
FIG. 5 is a plan view, somewhat schematic, of a vending machine for dispensing beverages and snack food products according to the present invention.

FIG. 5 depicts a vending machine 200 constructed according to the present invention. The vending machine 200 includes a housing 202, a barrier door 220, and a front door 240. The housing 202 may include separate sections or areas 204 for receiving stacks of containers as is known in the art and has a drop chute 208 which the containers slide down upon being selected and paid for by a purchaser. As discussed above with respect to vending machine 100, machine 200 is provided with drive motors (not shown) which operate a dispensing gate or other means disposed at the outlet of each container section 204 for releasing the container to the drop chute 208. The container slides down the drop chute and passes through an outlet formed in barrier door 220, as explained below.

The barrier door 220 is connected to the housing 202 at a hinge 210 so as to be movable toward and away from the housing. The barrier door typically will be formed from an insulative material and when closed prevents or reduces heat transfer between the interior of the housing 202 and the ambient environment. In the type of machine shown in FIG. 5, a hinged dispensing or trap door 224 closes the outlet of the barrier door 220 and is pushed open by the container as it slides down the drop chute 208 of housing 202 under the force of gravity, the container contacting the door 224 so as to pivot it open. However, as mentioned above, because containers filled with snack food product may be considerably lighter than beverage-filled containers, a problem may arise during use of this type of machine in that the snack food container does not weigh enough to open the dispensing door 224 after sliding down drop chute 208 under the force of gravity. As discussed below, the present invention includes a mechanism (indicated schematically at 226 in FIG. 5) for automatically opening the dispensing door 224 of barrier door 220. Preferably, the mechanism is actuated each time a snack food container is selected and opens the dispensing door 224 before the container has passed down the chute 208 to the door 224. The container passes through the open dispensing door 224 of barrier door 220 and then travels down dispensing passage 246 formed in the front door 240 of machine 200 to a dispensing outlet 248 where it can be accessed by the purchaser. The front door 240 also is hinged at 210 to the housing 202 and includes a display area 242, a coin insertion mechanism 244, and the aforesaid dispensing passage 246 and outlet 248.

Figure 6:
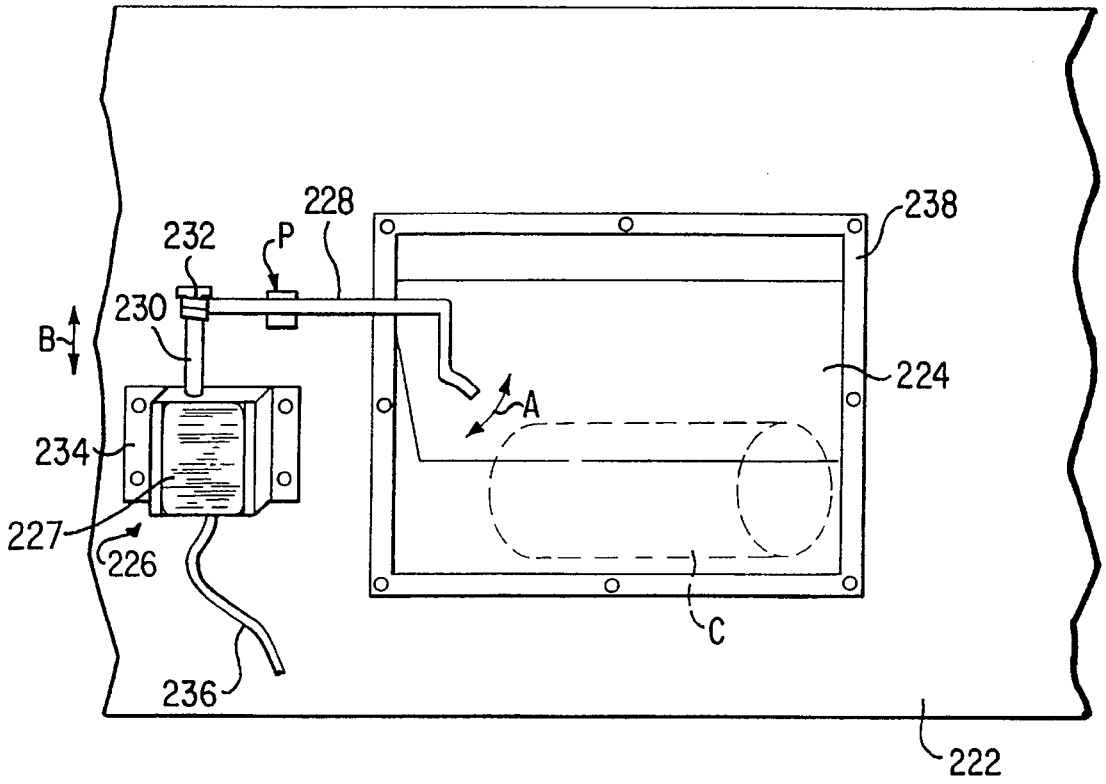
FIG. 6 is an elevation view of a portion of the barrier door of the vending machine depicted in FIG. 5.

FIG. 6 shows in somewhat schematic fashion a dispensing door-opening mechanism according to a preferred embodiment of the present invention which is indicated generally by reference numeral 226. The mechanism 226 includes a solenoid 227 secured to the inside surface 222 of barrier door 220 (FIG. 5). The solenoid 227 includes an arm 230 which is moved in a desired direction upon actuation of the solenoid by a suitable electrical signal. For example, the solenoid 227 includes a wire(s) 236 and receives the same signal used to power the motor for the dispensing gate of each dispensing section 204 of the machine. When a purchaser selects a snack food product, the electrical signal which powers the motor for the dispensing gate for the section 204 in which the product is located also powers the solenoid 227. When the dispensing gate is opened, the container is free to move from the stack or storage rack and onto the drop chute 208. The electrical signal causes the arm 230 of solenoid 227 to move downward in the direction of arrow B. A door-contacting member 228, which may be a stiff wire, has two ends, one end 232 being secured to the arm 230 of solenoid 227 and the other end 225 configured with a portion that projects outward toward the outside of the machine, i.e., in the direction that dispensing door 224 is opened. The member 228 is secured to the surface 222 at a pivot connection (indicated schematically at P in FIG. 6) located between the two ends. While a stiff wire is used in the illustrated embodiment, any type, size, or shape actuating member could be used to contact the door.

Figure 7:
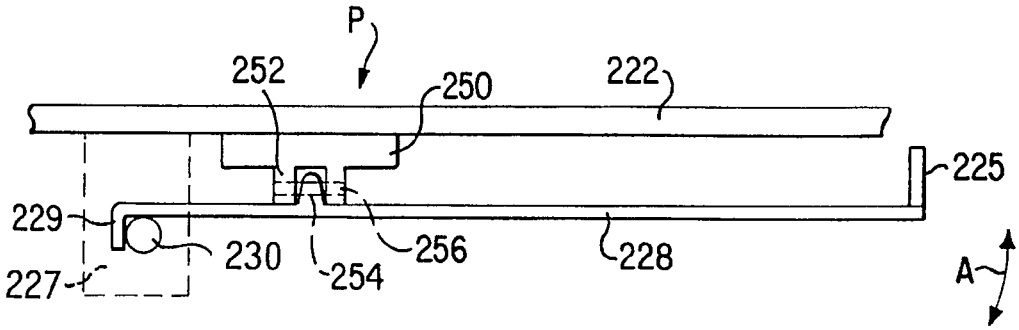
FIG. 7 is a plan view of the barrier door depicted in FIG. 6 including a mechanism for automatically opening the dispensing door of the barrier door to release a container to the outlet of the vending machine.

FIG. 7 depicts one possible arrangement which may be used to translate the motion of the arm 230 of the solenoid 227 into a force which acts in a generally transverse direction A to pivot open the door 224. A bracket 250 is secured to surface 222 and has a pair of ears 252 with openings passing therethrough. The door-contacting member 228 has a projection 254 located between the ears 252 with an opening aligned with the openings in ears 252 and a pivot pin 256 disposed in the aligned openings. Upon actuation of the solenoid 227, the arm 230 moves downward in direction B (into the page in FIG. 7) which causes the door-contacting member 228 to pivot about connection P so as to move the end 225 of member 228 in an outward direction along arrow A as seen in FIGS. 6 and 7. The solenoid 227 opens the dispensing door 224 before the container C (shown in phantom) travels from the supply stacks, down the drop chute and to the barrier door 220.

However, in view of the fact that some containers are located farther from dispensing door 224 than other containers, for example, those located at the back of the sections 204, it may be necessary to hold the door 224 open a sufficient length of time to permit such containers to travel from their storage position to the door 224. The door-opening mechanism of the present invention includes a time delay feature to ensure that the door 224 will be held open a sufficient length of time. A capacitor may be used to provide the mechanism with a desired time constant that will hold the door open long enough to allow the containers to reach the open dispensing door regardless of their position in the machine. The particular capacitor may be selected taking into consideration the electrical capacitance of the vending machine, etc., so that the desired time constant is obtained and the door is held open for the necessary length of time.

Those skilled in the art will recognize that the automatic door-opening feature of the present invention can be constructed in many different ways and a solenoid-operated mechanism is only one possible construction. Also, the particular configuration of the door-contacting member is not critical and can be in any form which permits it to open the door. For example, if a solenoid is used it can be mounted at virtually any location on the vending machine and, likewise, the door-opening member can be configured to engage the dispensing door from virtually any location. The particular configuration of the vending machine may influence or determine how or where the mechanism will be placed, e.g., adjacent the wires which will be used to supply power to the solenoid, on a wall that has open surface area, etc. Moreover, any type of vending machine may be used. For example, a machine having more than one outlet door could be utilized with the mechanism(s) of the invention controlling some or all of the doors. In any case, and whether a solenoid is used or not, the invention resides primarily in providing an automatic door-opening mechanism which opens the dispensing door of the machine before the containers filled with snack food product reach the door and, if necessary, maintains the door open a sufficient length of time to permit the containers to reach the door. Of course, the mechanism could open the door automatically for every product selected if desired.

In a preferred embodiment of the present invention, the snack food container 30 is pressurized at about 5–15 psi (pounds per square inch) to give it added strength so as to prevent the container (and snack food product) from being crushed or damaged during transportation, storage, etc.

Figure 4:
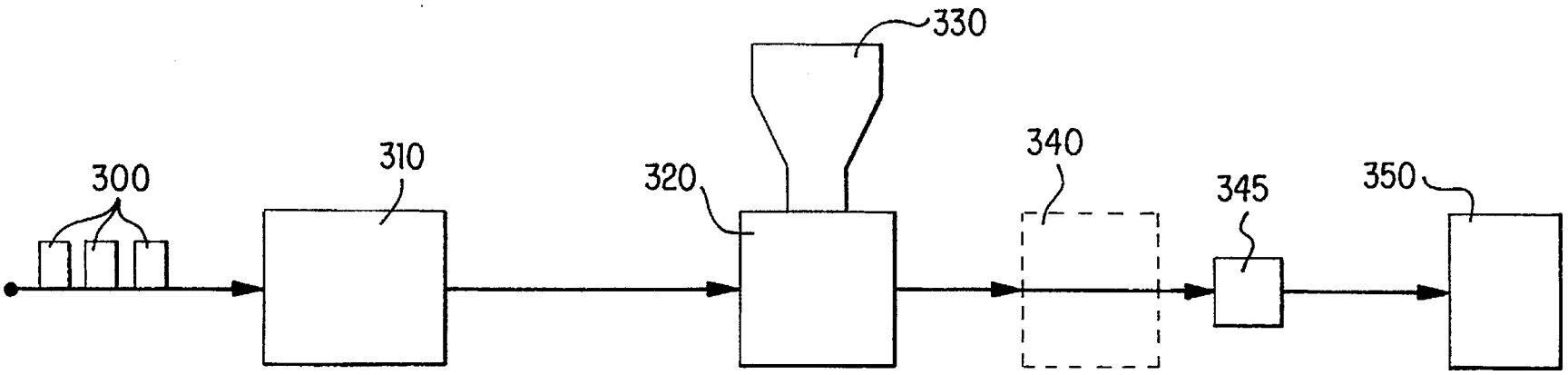
FIG. 4 is a schematic diagram of a process for packaging snack foods in a cylindrical container.

With reference to FIG. 4, a process for packaging snack foods in cylindrical containers 300 will now be described. The empty containers 300, which are open at the top thereof, preferably are flushed with nitrogen gas at a flushing station 310 to remove any oxygen present therein. The containers then are fed or directed to a filling station 320 equipped with a device or assembly that includes a filling head for dispensing precise metered amounts of the snack food product, e.g. corn chips, pretzels, cheese snacks, etc., from a supply 330 into the empty containers 300. The filling equipment can be in the form of a rotary table, conveyor belt or system, etc. The containers 300 should be positively captured or controlled during the filling process so that the amount of product placed therein can be controlled very accurately.

It may be desirable to also flush the product itself with nitrogen gas so as to substantially remove the oxygen captured or trapped therein to provide longer shelf life for the product. This can be done before the product is placed in the containers or, alternatively, may be accomplished after filling (but before sealing) of the containers by passing the filled containers through area 340 (shown in phantom). Area 340 may be in the form of a tunnel, chamber, etc., that contains a nitrogen rich environment to remove oxygen from the product as the containers pass therethrough. It is desirable to reduce the oxygen content of the product to about 2% or less in order to provide long shelf life and product freshness.

The containers are then sealed with a lid at a sealing station 350. The sealing of the containers may take place while the containers still are within the nitrogen environment, i.e., area 340 in FIG. 4.). The lids used to seal the containers, as described above with respect to FIG. 2B, are designed for easy removal. In a preferred embodiment, a small amount of liquid nitrogen is placed in the filled containers before the containers are sealed, as indicated by reference numeral 345 in FIG. 4. The liquid nitrogen evaporates after the containers are sealed to provide additional internal pressurization of the container, which in turn provides increased columnar and overall strength against crushing or deformation. In addition, the pressurization of the snack food container causes an audible noise upon opening which indicates the fresh and untampered condition of the product. As described above with respect to filled snack food container 30 shown in FIGS. 1B and 2B, the purchaser simply pulls up the ring 36 and completely removes cover 40 to gain access to the product.

As mentioned above, a significant benefit of packaging the snack foods in a container having substantially the same size and shape as a soft drink can is that conventional soft drink vending machines may be used to carry out the present invention. Therefore, while it is not necessary to utilize such similarly sized cans for packaging or containing the snack food products, a preferred embodiment of the present invention employs the same size can for both the beverage and snack food containers.

Another benefit of utilizing the soft drink vending machine in carrying out the process of the present invention is that the refrigerated environment present in the machine will maintain freshness of the snack food product for a longer period of time compared with storing such products at ambient temperatures. The lower storage temperature retards the oxidation of oil within the snack food, which in turn preserves the snack food's flavor for a longer period of time.

It is apparent that the present invention provides an improved process for dispensing both beverages and snack food products from a vending machine, as well as a process for packaging snack foods in cylindrical containers suitable for being dispensed from a vending machine.

Although the present invention has been described with reference to particular embodiments, it is to be understood that the embodiments are merely illustrative of the application of the principles of the invention. Numerous configurations may be made therewith and other arrangements may be devised without departing from the spirit and scope of the invention.

I claim:

1. A process for dispensing beverages and snack food products from a single vending machine, the process comprising steps of:

providing a vending machine having a storage portion for storing containers which have a size and shape so as to be receivable in the storage portion of said vending machine, a single outlet in communication with each of said containers and a movable dispensing door blocking the outlet, the containers moving from the storage portion and through the dispensing door which opens selectively to the outlet when selected by a user;

placing a plurality of containers filled with a beverage in the storage portion of said vending machine, each of the plurality of filled beverage containers having substantially the same size and shape;

placing a plurality of containers filled with a snack food product in the storage portion of said vending machine, each of the plurality of filled snack food containers having a size and shape that are substantially the same as the size and shape of the filled beverage containers; and providing the vending machine with a mechanism for opening the movable dispensing door automatically at least when a snack food container is selected by the user;

whereby said vending machine is capable of dispensing both a filled beverage container and a filled snack food container from said single outlet.

2. A process according to claim 1, wherein the plurality of beverage containers and the plurality of snack food containers comprise an aluminum can with a sealed access opening.

3. A process according to claim 1, wherein the beverage containers and the snack food containers comprise a cylindrically-shaped can which has about a 12 fluid ounce capacity.

4. A process according to claim 1, wherein the storage portion of said vending machine is refrigerated.

5. A process according to claim 1, wherein the mechanism opens the dispensing door only when a snack food container is selected.

6. A process according to claim 5, wherein the mechanism holds the dispensing door open a certain period of time to permit the containers to travel from the storage area to the dispensing door.

7. A process according to claim 1, wherein the mechanism includes a solenoid which receives an electrical signal and moves a door-contacting member that contacts and opens the dispensing door at least when a snack food container is selected.

8. A process for dispensing both filled beverage containers and filled snack food containers from a vending machine configured to dispense soft drink containers, the process comprising steps of:

providing a vending machine having at least first and second refrigerated storage portions, both of said refrigerated storage portions configured to receive a plurality of containers and in communication with a single outlet, the containers having a uniform size such that when filled the machine contains a plurality of containers having a uniform size, the vending machine further including means for selecting either a beverage or snack food container and means, responsive to the selecting means, for releasing a selected container from the storage portion of the machine to a dispensing door which opens to said single outlet;

placing a plurality of containers filled with a beverage in the first refrigerated storage portion of said vending machine;

placing a plurality of containers filled with a snack food product in the second refrigerated storage portion of said vending machine; and automatically opening the dispensing door at least each time a snack food container is selected by a user whereby the selected container is released from the storage portion and passes through the open door to the outlet of the machine;

whereby a user may obtain both a snack food product and a beverage from said single outlet of said vending machine.

9. A process according to claim 8, wherein the dispensing door opens only when a snack food container is selected.

10. A process according to claim 8, wherein the dispensing door is held open a certain period of time to permit the containers to travel from the storage area to the outlet.

11. A process according to claim 8, wherein the dispensing door is opened by a mechanism comprising a solenoid which receives an electrical signal and moves a door-contacting member which contacts and opens the dispensing door at least each time a snack food container is selected.

12. A vending machine for dispensing both filled beverage containers and filled snack food containers, the vending machine configured to dispense a container through an outlet when a user selects the container, the machine comprising:

at least first and second refrigerated storage portions, both of said refrigerated storage portions being configured to receive a plurality of substantially uniform size and shape containers;

a pathway leading from the storage portions to a single dispensing door which is opened to permit the containers to pass to the outlet of the machine;

a selecting device for selecting either a beverage or snack food container and a drive mechanism which is responsive to the selecting device and moves the selected container from the storage portion to the single dispensing door;

a device for opening the dispensing door when a user selects a snack food container and keeping the door open to allow the snack food container to travel from the storage portion to the outlet;

a plurality of containers filled with a beverage being disposed in the first refrigerated storage portion of said vending machine; and a plurality of containers filled with a snack food product being disposed in the second refrigerated storage portion of said vending machine.

13. A vending machine according to claim 12, wherein the beverage containers and the snack food containers comprise a cylindrically-shaped can which has about a 12 fluid ounce capacity.

14. A vending machine according to claim 12, wherein the opening device opens the dispensing door only when a snack food container is selected.

15. A vending machine according to claim 12, wherein the opening device includes a solenoid which receives an electrical signal and moves a door-contacting member to contact and open the dispensing door when a snack food container is selected.

16. A vending machine according to claim 15, wherein the solenoid is secured to the machine and has an arm attached to the door-contacting member, and the door-contacting member is pivotally mounted and has an end disposed away from the arm of the solenoid which contacts and opens the door when the solenoid is actuated.

17. A vending machine according to claim 12, wherein the plurality of snack food containers and the plurality of beverage containers have a substantially uniform size so that the first and second storage portions of said machine can receive either the snack food containers or the beverage containers.

* * * * *

UNITED STATES PATENT AND TRADEMARK OFFICE

CERTIFICATE OF CORRECTION

PATENT NO. : 5,613,620
DATED : March 25, 1997
INVENTOR(S) : John L. Center et al.

It is certified that error appears in the above-indentified patent and that said Letters Patent is hereby corrected as shown below:

In the Claims: Claim 12, line 10, after "permit the" insert -- substantially uniform size and shape --.

Signed and Sealed this

Sixteenth Day of December, 1997

Bruce Lehman

*Attest:*

BRUCE LEHMAN

*Attesting Officer*

*Commissioner of Patents and Trademarks*